US007517079B2

(12) United States Patent
Arai

(10) Patent No.: US 7,517,079 B2
(45) Date of Patent: Apr. 14, 2009

(54) IMAGE FORMING METHOD AND IMAGE FORMING APPARATUS

(75) Inventor: Noriyuki Arai, Chichibu (JP)

(73) Assignee: Canon Kabushiki Kaisha, Tokyo (JP)

( * ) Notice: Subject to any disclaimer, the term of this patent is extended or adjusted under 35 U.S.C. 154(b) by 458 days.

(21) Appl. No.: 11/385,403

(22) Filed: Mar. 21, 2006

(65) Prior Publication Data

US 2006/0227195 A1 Oct. 12, 2006

(30) Foreign Application Priority Data

Mar. 25, 2005 (JP) ..... 2005-088620
Apr. 27, 2005 (JP) ..... 2005-128965
Jun. 8, 2005 (JP) ..... 2005-168211

(51) Int. Cl.
*B41J 2/01* (2006.01)

(52) U.S. Cl. ..... 347/104; 347/102; 347/103; 271/293

(58) Field of Classification Search ..... 347/103, 347/102, 104
See application file for complete search history.

(56) References Cited

U.S. PATENT DOCUMENTS 7,014,288 B2 * 3/2006 Maeda ..... 347/16
7,367,553 B2 * 5/2008 Sato ..... 271/10.11
2002/0070991 A1 6/2002 Otsuki

FOREIGN PATENT DOCUMENTS

JP 08-108590 A 4/1996
JP 2002-283635 10/2002
JP 2005-022647 A 1/2005

* cited by examiner

*Primary Examiner*—Stephen D Meier
*Assistant Examiner*—Ly T Tran
(74) *Attorney, Agent, or Firm*—Canon USA, Inc IP Div

(57) ABSTRACT

An image forming apparatus includes upstream and downstream transport rollers for transporting a recording paper sheet. The upstream transport roller is disposed on the upstream side of a recording head while the downstream transport roller is disposed on the downstream side of the recording head. When forming an image on the first half area of the recording sheet, the upstream transport roller rotates and is responsible for transporting the recording sheet. When forming an image on the second half area of the recording sheet, the downstream transport roller rotates and is responsible for transporting the sheet. This structure provides printing without margins at the leading and trailing edges of the sheet. By adjusting the gap sizes between rollers in each of the upstream and the downstream rollers, the transport speed of the sheet is maintained constant so that high-quality print image can be obtained without uneven density in an image.

8 Claims, 7 Drawing Sheets

IMAGE FORMING METHOD AND IMAGE FORMING APPARATUS

BACKGROUND OF THE INVENTION

1. Field of the Invention

The present invention relates to an image forming method and an image forming apparatus for use in a printer unit and a facsimile unit including a recording head as recording means.

2. Description of the Related Art

In general, ink thermal dye sublimation printers that print image information on a sheet of chemically treated recording paper using a thermal transfer ribbon have a recording head and a platen roller. The platen roller presses the sheet against the recording head when an image is formed. In the recording head, a plurality of heating elements are arranged in a line and a plurality of the lines are arranged in parallel. The heating elements are selectively heated on the basis of image information so that ink on the ink ribbon sublimes and the image information is transferred to a recording surface of the sheet. Thus, a print operation is performed.

In this structure, the sheet transport mechanism includes a powered feed roller and a cooperating presser roller. The two rollers pinch the sheet and pull the sheet through to transport the sheet. In general, such a transport mechanism is disposed upstream or downstream of the recording head. During recording, the transport mechanism pinches the sheet to support the sheet at all times. Technology associated with such a mechanism is described in, for example, Japanese Patent Laid-Open No. 08-108590. Additionally, for color printing, one color print operation is performed once per transportation of the sheet. By driving the feed roller in a clockwise direction or in a counterclockwise direction, a different color ink is printed one on top of the other. Thus, a color image is formed.

However, as discussed in Japanese Patent Laid-Open No. 08-108590, since the transport mechanism of known thermal recording printers is disposed either upstream or downstream of the recording head serving as recording means, the following problem occurs.

Since, during recording, the transport mechanism pinches the sheet to be recorded upon by the recording head to feed the sheet at all times, a space for griping the sheet must be provided at the recording start edge and the recording end edge of the sheet. Accordingly, a margin is provided at the leading edge and the trailing edge of the sheet in the feed direction. Since these areas are unprintable areas, the entire surface of the sheet cannot be used.

SUMMARY OF THE INVENTION

The present invention provides an image forming method and an image forming apparatus for forming an image on the entire recording area of a sheet without losing a space for a margin, thereby making efficient use of the recording area of the sheet.

According to a first aspect of the present invention, there is provided an image forming method. According to a second aspect of the present invention, there is provided an image forming apparatus.

According to an embodiment of the present invention, an image forming method includes the steps of feeding a sheet medium to be recorded upon by forming an image thereon into an image forming unit by using first transporting means disposed on the upstream side of the image forming unit when forming an image in the first half recording area starting from a recording start edge of the sheet medium, and pulling out the sheet medium from the image forming unit and transporting the sheet medium by using second transporting means disposed on the downstream side of the image forming unit when forming an image in the second half recording area of the sheet medium so as to form an image substantially in the entire surface of the sheet medium with a minimum margin.

As described above, the sheet medium is transported from the upstream side to the downstream side while passing over the image forming unit. In this case, while an image is being formed in the first half recording area, the first transporting means disposed on the upstream side is responsible for transporting the sheet medium and feeds the sheet medium into the image forming unit. While the sheet medium is exiting the image forming unit and an image is being formed in the second half recording area, the second transporting means disposed on the downstream side is responsible for transporting the sheet medium by gripping and pulling in the sheet medium. Thus, the image is formed in the entire recording area without generating margins at the leading edge and the trailing edge of the sheet medium.

According to another embodiment of the present invention, an image forming apparatus includes a feeder unit for feeding a sheet medium, an image forming unit for forming an image on the sheet medium, first transporting means for transporting the sheet medium, and second transporting means for transporting the sheet medium. The sheet medium is fed from the feeder unit, the sheet medium passes over the image forming unit. After the sheet medium has passed over the image forming unit into upstream side, the sheet medium is fed from the upstream side towards the image forming unit in the opposite direction by using the first transporting means disposed on the upstream side, an image is formed on the sheet medium by the image forming unit, and the sheet medium is pulled out from the image forming unit towards the downstream side by the second transporting means disposed on the downstream side.

Accordingly, in this structure, the sheet medium fed from the feeder unit (e.g., feeder cassette) is transported until the first half area passes over the image forming unit. When the side on which the first half area is present is defined as an upstream side of the image forming unit and the opposite side is defined as a downstream side, the image forming unit forms an image on the sheet medium while the sheet medium is being transported from the upstream side to the downstream side. The first transporting means disposed on the upstream side is responsible to transport the sheet medium while the first half recording area in the transport direction is being recorded. The second transporting means disposed on the downstream side is responsible to transport the sheet medium while the second half recording area in the transport direction is being recorded. That is, spaces for pinching and gripping the sheet medium are not necessary at the leading edge and the trailing edge of the sheet medium in the transport direction. Accordingly, an image can be formed in the entire area along the entire length of the sheet medium.

As stated above, according to an image forming method according the present invention, when forming an image on a sheet medium by transporting the sheet medium from the upstream side to the downstream side of an image forming unit, first transporting means and second transporting means pinch the sheet medium to feed the sheet medium into the image forming unit and pull out the sheet medium from the image forming unit. This structure eliminates the need for margins for pinching and gripping the sheet medium at the leading edge and the trailing edge of the sheet medium.

Additionally, according to an image forming apparatus according the present invention, first transporting means and second transporting means are provided on the upstream side and on the downstream side of an image forming unit, respectively. In addition, the first transporting means and the second transporting means are responsible for transporting the sheet medium while recording the first half recording area and the first half recording area of the sheet medium in the transport direction, respectively. This structure eliminates the need for margins for pinching and gripping the sheet medium at the leading edge and the trailing edge of the sheet medium in the transport direction in order to feed and pull out the sheet medium into and from the image forming unit. Furthermore, an image can be formed on the entire recording area of the sheet medium without losing a space for a margin, thereby making efficient use of the recording area of the sheet medium.

Further features of the present invention will become apparent from the following description of exemplary embodiments with reference to the attached drawings.

DESCRIPTION OF THE EMBODIMENTS

An image forming method and an image forming apparatus according to an embodiment of the present invention is now herein described in detail with reference to the accompanying drawings.

Figure 1:
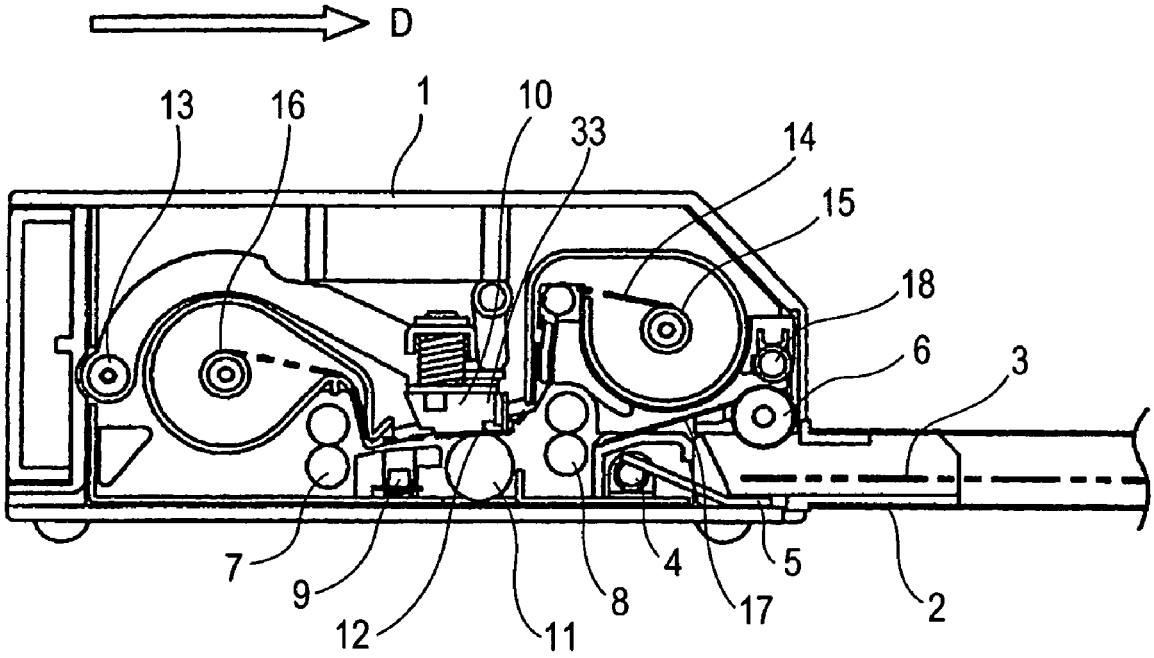
FIG. 1 is a sectional view of a thermal printer, which is one type of image forming apparatus according to an embodiment of the present invention.

FIG. 1 illustrates a main portion of a thermal printer 1 as an embodiment of an image forming apparatus. Image information is delivered from an upper-level system including a digital apparatus (e.g., a personal computer or a digital camera) or a host computer to a control unit (not shown) of the thermal printer 1 via, for example, a connection cable. Upon receiving the image information, the control unit starts a recording operation to form an image on a sheet 3 of recording paper.

The sheet 3 contained in a feeder tray (feeder unit) 2 is pressed against a feed roller 6 by an up/down plate 5 that swings up and down about an up/down plate shaft 4. Rotation of the feed roller 6 picks up the sheet 3. The sheet 3 is then fed into the apparatus body. The main part of an image forming unit of the thermal printer 1 is a recording head 10 serving as recording means that records an image on the sheet 3. The sheet 3 fed by the feed roller 6 is transported until the sheet 3 passes through the recording head 10. In FIG. 1, the position at the left of the recording head 10 is the position at which a recording operation on the sheet 3 starts. Therefore, the sheet 3 is delivered from the feeder tray 2 located at the right of the recording head 10 to the recording start position located at the left of the recording head 10. Subsequently, the sheet 3 moves back in a direction indicated by arrow D to start an image forming operation.

For the sake of simplicity, the left side from the recording head 10 of the image forming unit is referred to as an upstream side of a sheet transport system. The right side from the recording head 10 is referred to as a downstream side of the sheet transport system. Also, the direction from the upstream side to the downstream side (indicated by arrow D) is referred to as a "print delivery" direction. The direction from the downstream side to the upstream side (i.e., feed direction from the feeder tray 2) is referred to as a "feed" direction.

On the upstream side of the recording head 10, first delivery means (hereinafter referred to as an "upstream delivery roller pair 7") is provided. Also, on the downstream side of the recording head 10, second delivery means (hereinafter referred to as a "downstream delivery roller pair 8") including upper and lower delivery rollers is provided. Each of the upstream and downstream delivery roller pairs 7 and 8 is rotatable in both rotational directions, namely, in the counterclockwise direction so as to deliver the sheet 3 in the print delivery direction and in the clockwise direction so as to deliver the sheet 3 in the feed direction. That is, the sheet 3 fed from the feeder tray 2 is delivered into the interior of the apparatus body from the downstream delivery roller pair 8. Subsequently, the sheet 3 is delivered to the recording start position in cooperation with the upstream delivery roller pair 7.

Figure 2:
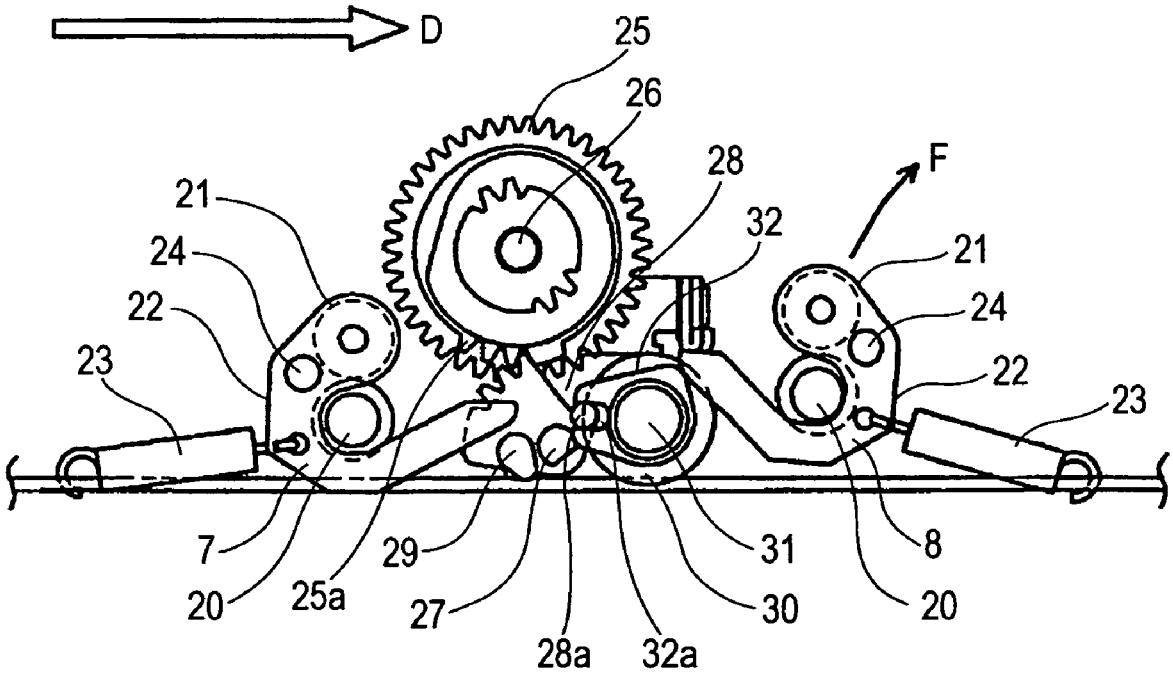
FIG. 2 is a sectional view illustrating the operation of a pinch adjustment mechanism provided in an upstream transport roller and a downstream transport roller according to the embodiment.

A pinch adjustment mechanism in the upstream delivery roller pair 7 and the downstream delivery roller pair 8 is now herein described with reference to all of the drawings subsequent to FIG. 2.

The pinch adjustment mechanism of the upstream delivery roller pair 7 includes a feed roller 20, a sheet pressure roller 21, a sheet pressure lever 22, and a roller pressure spring 23. The feed roller 20 includes a roller shaft serving as a rotation shaft. Both ends of the roller shaft are supported by a housing of the printer apparatus. A gear (not shown) is formed at one end of the feed roller 20. This gear is engaged with a driving gear train (not shown) whose one end is coupled with a transport motor 217 (see FIG. 5) serving as a rotary drive source. The rotation of the rotary drive source rotates the feed roller 20. On a surface of the feed roller 20, a plurality of irregularities is formed so that the feed roller 20 can reliably grip and feed the sheet 3.

The sheet pressure roller 21 is disposed in parallel to the feed roller 20. Both ends of the sheet pressure roller 21 are rotatably supported by the sheet pressure lever 22. To prevent the irregularities formed on the surface of the feed roller 20 from being damaged, a spacer (not shown) is disposed between the feed roller 20 and the sheet pressure roller 21 so that a gap with a predetermined size is formed between the feed roller 20 and the sheet pressure roller 21.

Figure 3:
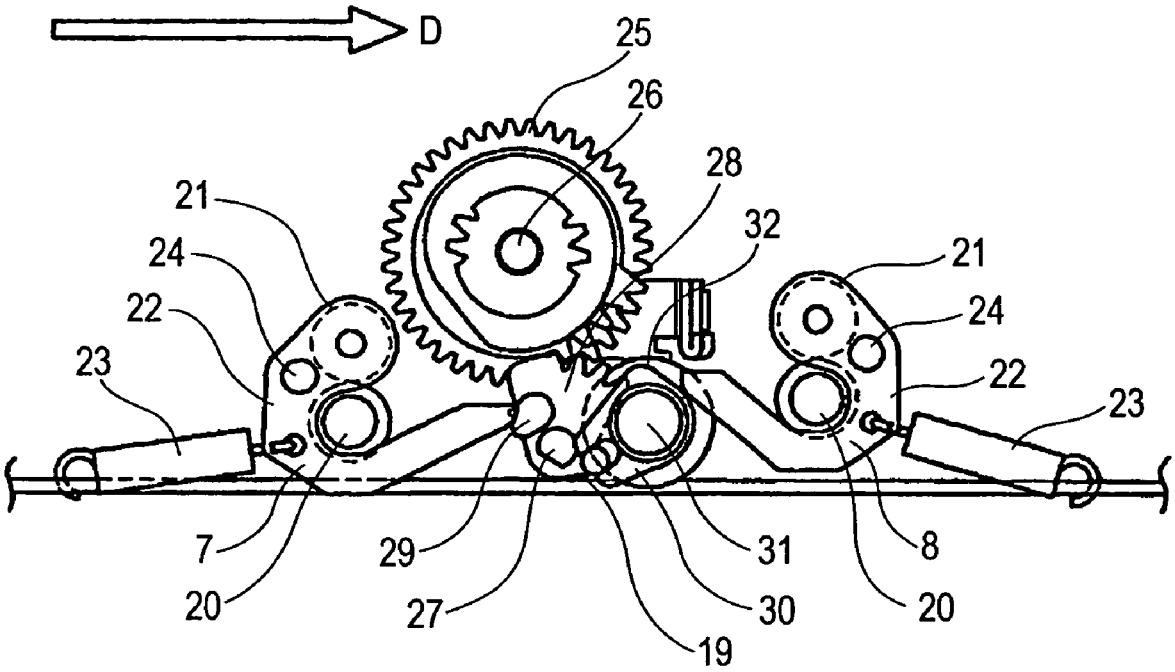
FIG. 3 is another sectional view illustrating the operation of the pinch adjustment mechanism provided in the upstream transport roller and the downstream transport roller according to the embodiment.
Figure 4:
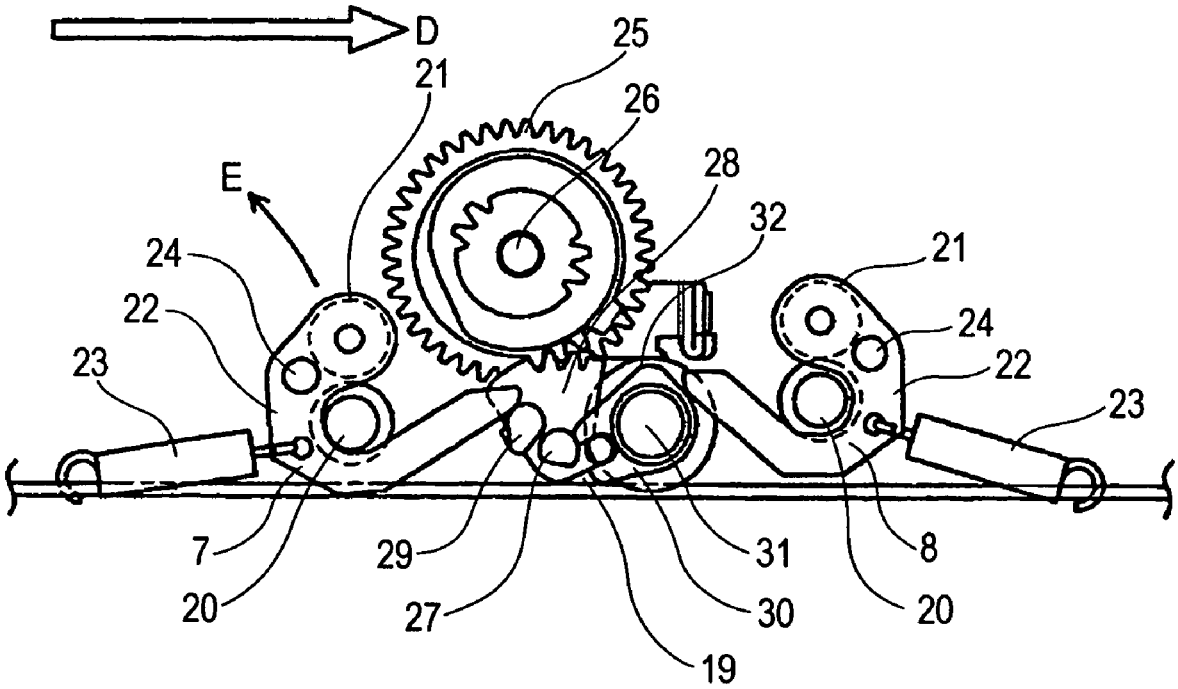
FIG. 4 is another sectional view illustrating the operation of the pinch adjustment mechanism provided in the upstream transport roller and the downstream transport roller according to the embodiment.

The sheet pressure lever 22 is rotatably supported by a sheet pressure lever shaft 24, which is supported by a housing of the apparatus. As shown in FIGS. 2 to 4, the roller pressuring spring 23 is an extension spring whose both ends are hooked portions respectively hooked to the sheet pressure lever 22 and the housing. Thus, the sheet pressure roller 21 is in contact with the feed roller 20 via the sheet pressure lever 22 at a predetermined pressure. The sheet 3 is pinched by the feed roller 20 and the sheet pressure roller 21 in a gap therebetween. The irregularities formed on the surface of the feed roller 20 can help the feed roller 20 reliably grip and feed the sheet 3.

The downstream delivery roller pair 8 basically has the similar structure to that of the upstream delivery roller pair 7, and therefore, the same components as those in the upstream delivery roller pair 7 are designated by the same reference numerals and the descriptions are not repeated.

A cam portion 19 includes a cam gear 25 rotatably supported by a cam gear shaft 26. The cam gear 25 is driven by a cam motor 218, which is a different rotary drive source from that of the feed roller 20. A second cam gear 28 is rotatably supported by a second cam gear shaft 27. The second cam gear 28 is mounted at either end of the second cam gear shaft 27 and is engaged with a gear portion 25*a* of the cam gear 25. The second cam gear 28 includes a cam-shaped section 29. As shown in FIG. 4, the cam-shaped section 29 can push up the sheet pressure lever 22 of the upstream delivery roller pair 7. By pushing up the sheet pressure lever 22, the second cam gear 28 can move the sheet pressure roller 21 of the upstream delivery roller pair 7 so as to increase the size of the gap between the feed roller 20 and the sheet pressure roller 21.

A cam 30 is rotatably attached to either end of a platen roller shaft 31. The cam 30 is turned by the second cam gear 28. A protrusion 28*a* provided on the second cam gear 28 is engaged with a depression 32*a* provided on the cam 30 so that the rotation of the second cam gear 28 is transferred to the cam 30. In addition, a cam-shaped section 32 provided on the cam 30 can push up the sheet pressure lever 22 of the downstream delivery roller pair 8. By pushing up the sheet pressure lever 22, the cam 30 can move the sheet pressure roller 21 of the downstream delivery roller pair 8 so as to increase the size of the gap between the feed roller 20 and the sheet pressure roller 21, as shown in FIG. 2.

Figure 5:
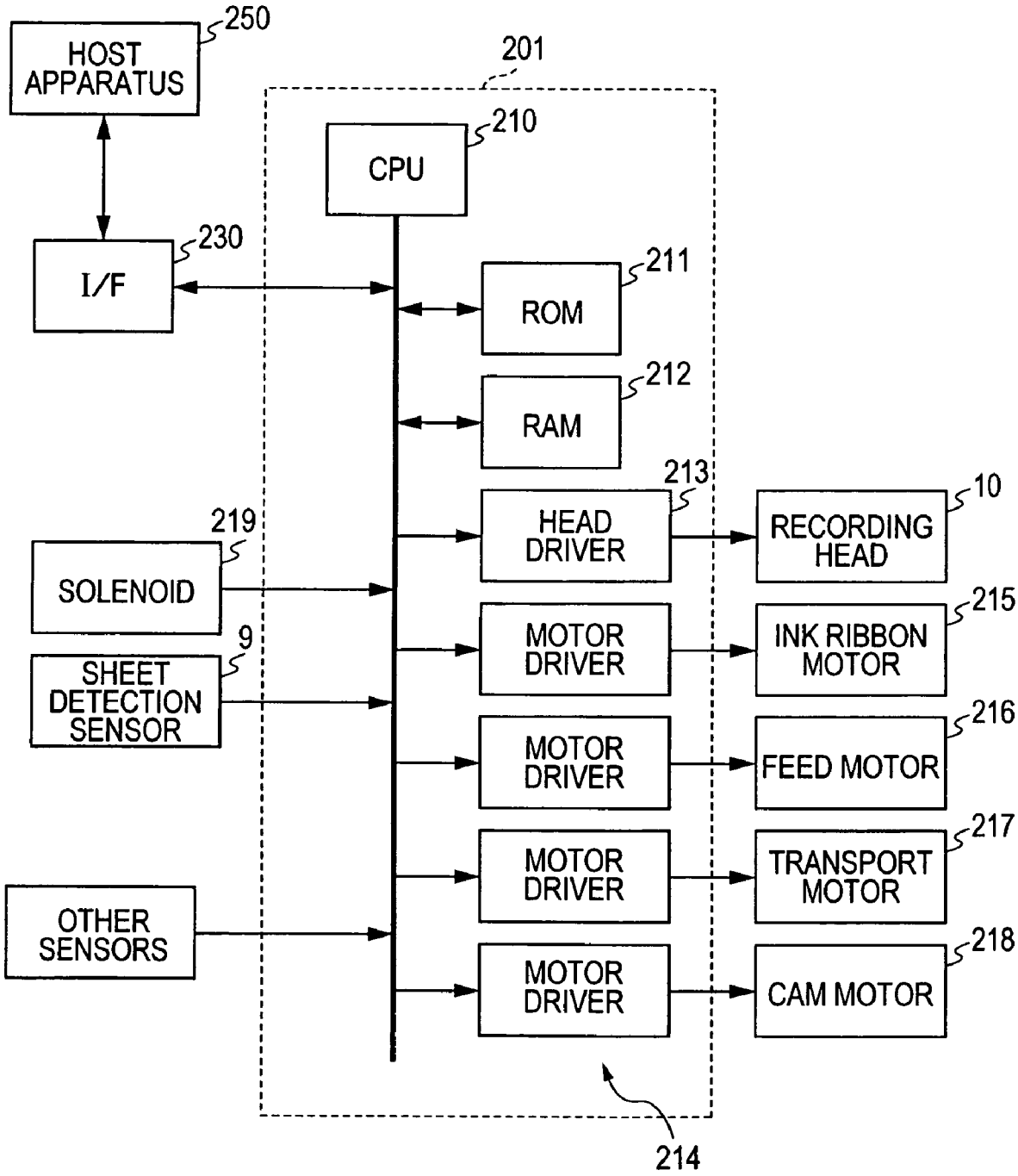
FIG. 5 is a circuit block diagram according to the embodiment.

FIG. 5 is a control block diagram of a printer apparatus. A control board 201 serving as a control unit includes a central processing unit (CPU) 210, a read only memory (ROM) 211, a random access memory (RAM) 212, a head driver 213, and motor drivers 214. The CPU 210 controls a duplex recording unit and outputs a variety of control commands. The ROM 211 stores control data and the like. The RAM 212 serves as an area where recording data is expanded. The head driver 213 drives the recording head (thermal head) 10. An ink ribbon motor 215 drives a pulley 15 to reel in an ink ribbon 14. A feed motor 216 drives the feed roller 6. A transport motor 217 drives the feed roller 20 of the upstream delivery roller pair 7, the feed roller 20 of the upstream delivery roller pair 8, and a platen roller 11. The plurality of motor drivers 214 drive the above-described motors. A solenoid 219 is an actuator used to move a head arm. An interface 230 receives and transmits data from and to a host apparatus 250 (e.g., a computer or a digital camera).

An image forming method using such a structure is now herein described.

The sheet 3 is picked up from the feeder tray 2 by the feed roller 6, and the feeding of the sheet 3 starts. In synchronization with this operation, the recording head 10 and the platen roller 11 operate so that the distance between the recording head 10 and the platen roller 11 increases and a gap that allows the sheet 3 to pass therethrough is ensured between the recording head 10 and the platen roller 11. At the same time, in each of the upstream delivery roller pair 7 and the downstream delivery roller pair 8, the pinch adjustment mechanism (see FIGS. 2, 3, and 4) operates so that an optimum gap for griping and feeding the sheet 3 is determined to be the thickness of the sheet 3.

When the sheet 3 is fed in from the downstream side and moves past the recording head 10, a sheet detection sensor 9 detects the passage of the trailing edge of the sheet 3 (starting edge when recording is started). The control unit of the thermal printer 1 outputs an operation-stop signal on the basis of a sheet-passage detection signal from the sheet detection sensor 9 to stop the rotation of the upstream delivery roller pair 7 and the downstream delivery roller pair 8 driven by the transport motor 217. Thus, the feeding-in of the sheet 3 is stopped. The position at which the sheet 3 is stopped is the recording start position.

(First Half Recording Area)

Subsequently, the control unit of the thermal printer 1 outputs an operation-switch signal to rotate the transport motor 217 in the opposite direction from that during feed-in time. The feed roller 20 of the upstream delivery roller pair 7 starts rotating in the clockwise direction so that the sheet 3 that has been stopped at the recording start position advances towards the recording head 10 in the print-feed direction shown by arrow D in the drawings. In this case, the trailing edge of the sheet 3 at the feed-in time becomes the recording start edge and moves towards the recording head 10. An image is formed in an area from exactly at the recording start edge to substantially the middle point of the sheet 3. Thus, recording is performed in the first half recording area of the sheet 3.

(Second Half Recording Area)

The recording start edge of the sheet 3 whose first half recording area has been recorded moves towards the downstream delivery roller pair 8. Immediately before the recording start edge of the sheet 3 moves into the downstream delivery roller pair 8, the pinch adjustment mechanism of the downstream delivery roller pair 8 increases the gap size between the rollers to a size greater than or equal to the thickness of the sheet 3 so that the downstream delivery roller pair 8 is ready for receiving the sheet 3. That is, the state shown in FIG. 2 is achieved by the cam motor 218. Thus, the downstream delivery roller pair 8 receives the sheet 3 from the upstream delivery roller pair 7. The downstream delivery roller pair 8 grips the sheet 3 at the recording start edge to pull in the sheet 3. Subsequently, the recording continues in the second half recording area of the sheet 3 and the remaining image is formed in that area.

As shown in FIG. 1, while recording is performed in the first half and the second half recording area, the recording head 10, which swings about a head arm shaft 13, moves towards the platen roller 11 to press the ink ribbon 14 and the sheet 3 together against the platen roller 11. At the same time, the pinch adjustment mechanism of the upstream delivery roller pair 7 is activated so that a gap size between the rollers are adjusted to an optimum size for gripping the sheet 3 and feeding the sheet 3 to a position corresponding to the recording head 10.

When the heating element line 12 on the recording head 10 transfers ink from the ink ribbon 14 onto the sheet 3 on the basis of image information, the recording operation starts. In synchronization with this operation, the upstream delivery roller pair 7 is activated to grip the sheet 3 and feed the sheet 3 in the print feed direction towards the downstream side. The upstream delivery roller pair 7 is responsible for feeding the sheet 3 during image formation in the first half recording area starting from the printing start edge of the sheet 3. At that time, the pulley (ink ribbon take-up reel) 15 rotates to start reeling in the ink ribbon 14 whose ink has been transferred to the sheet 3. However, the ink ribbon 14 not used for transfer is wound around an ink ribbon supply reel 16, which supplies the ink ribbon 14 in synchronization with the reeling operation of the ink ribbon take-up reel 15.

The downstream delivery roller pair 8 is responsible for feeding the sheet 3 during image formation in the second half recording area of the sheet 3 after receiving the sheet 3 whose first half recording area has been recorded. As shown in FIG. 2, when the sheet 3 enters a nip defined by the rollers of downstream delivery roller pair 8, the pinch adjustment mechanism of the downstream delivery roller pair 8 increases the gap size between the rollers to a size greater than or equal to the thickness of the sheet 3 so that a transport friction force is not applied to the sheet 3. The reason why the friction force is not applied to the sheet 3 in the downstream delivery roller pair 8 is that a shock is reduced when the image forming start edge of the sheet 3 enters a sheet holding portion that has a small nip. If a shock is large when the image forming start edge of the sheet 3 enters a sheet holding portion that has a small nip, the uniformity of the transport speed of the sheet 3 is not maintained, and therefore, density mottles that degrade the image quality appear.

When the recording start edge of the sheet 3 reaches the downstream delivery roller pair 8 and has moved past the downstream delivery roller pair 8 a certain amount of distance, the cam motor 218 is driven to rotate the cam gear 25 and the cam 30, as shown in FIG. 4. Thus, the gap size between the rollers of the downstream delivery roller pair 8 is decreased to pinch and feed the sheet 3. At that time, the gap size between the rollers of the upstream delivery roller pair 7 is increased to a size more than or equal to the thickness of the sheet 3 by the cam-shaped section 29, and therefore, the upstream delivery roller pair 7 does not interrupt the movement of the sheet 3 towards the downward direction.

Even when the moving distance of the sheet 3 moved by the upstream delivery roller pair 7 is set to be equal to the moving distance of the sheet 3 moved by the downstream delivery roller pair 8, the moving distances, in practice, are different due to part-to-part variation in precision. Additionally, if the feed time for which the upstream delivery roller pair 7 and the downstream delivery roller pair 8 grip the leading edge and trailing edge of the sheet 3 is too long, the sheet 3 may become stretched or deflected between the upstream delivery roller pair 7 and the downstream delivery roller pair 8. As a result, the feeding speed varies, thereby causing uneven density on a print image. To prevent the variation in the feeding speed and output a stable high-quality print image, the upstream delivery roller pair 7 and the downstream delivery roller pair 8 are controlled so that the feeding forces of the two do not act at the same time.

Subsequently, the downstream delivery roller pair 8 continues to feed the sheet 3 until the recording end edge of the second half recording area of the sheet 3 passes the heating element line 12 on the recording head 10. After the sheet 3 has passed the recording head 10, the rotation of the downstream delivery roller pair 8 is stopped. At the same time, the reeling operation of the ink ribbon 14 is stopped. Thus, a recording operation to form an image of a first color is completed. This operation is repeated several times for all the colors so that ink of several different colors is printed on the sheet 3 one on top of the other to form a color image. After the color image is formed, the sheet 3 is led to an exit path by a flap 17. Thereafter, the recorded sheet 3 is output onto the feeder tray 2 by the feed roller 6 and an output paper pressure roller 18 which cooperatively work together.

As described above, a recording operation can be performed by forming an image substantially in the entire length area starting from the leading edge to the trailing edge of the sheet 3 in the feed direction. In addition, margins corresponding to spaces for gripping are not generated at the leading edge and the trailing edge of the sheet 3 that are generated in a known printer apparatus. As a result, the entire space of the sheet 3 can be efficiently used.

When the sheet 3 advances from the upstream delivery roller pair 7 to the downstream delivery roller pair 8, the downstream delivery roller pair 8 pinches the sheet 3 at the same time as the upstream delivery roller pair 7 increases the gap size between the rollers thereof. However, the upstream delivery roller pair 8 may pinch the sheet 3 while the upstream delivery roller pair 7 pinches the sheet 3. Thereafter, the upstream delivery roller pair 7 may increase the gap size between the rollers thereof.

Figure 6:
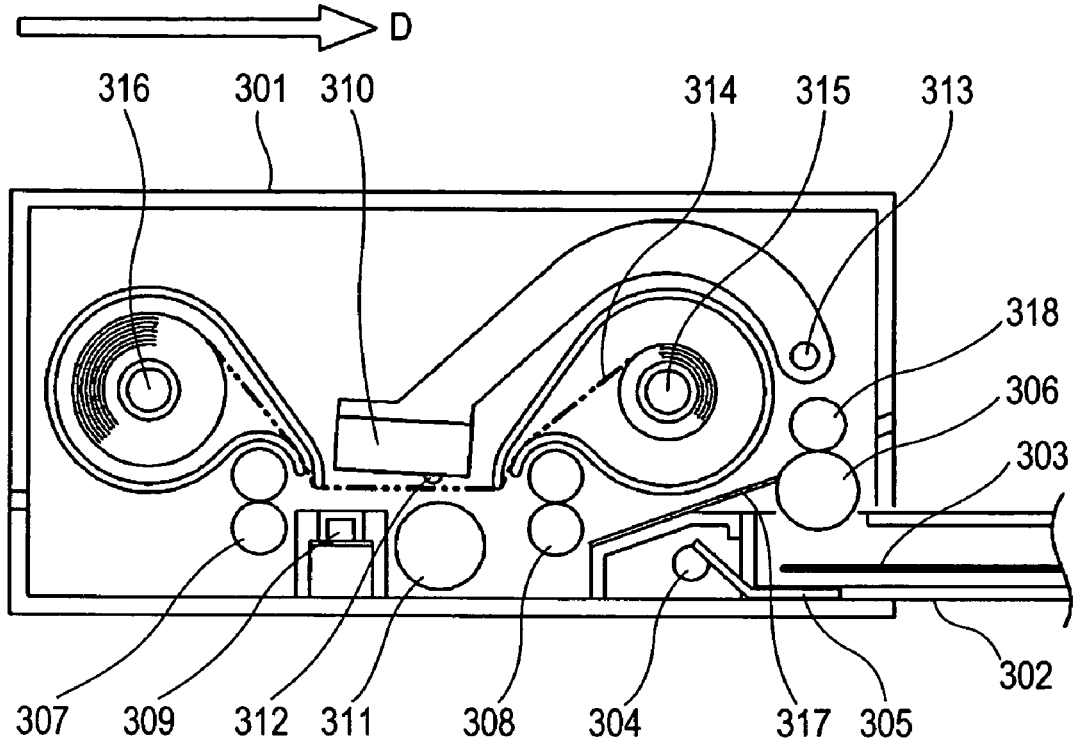
FIG. 6 is a schematic sectional view of a recording apparatus according to a second embodiment of the present invention.
Figure 7:
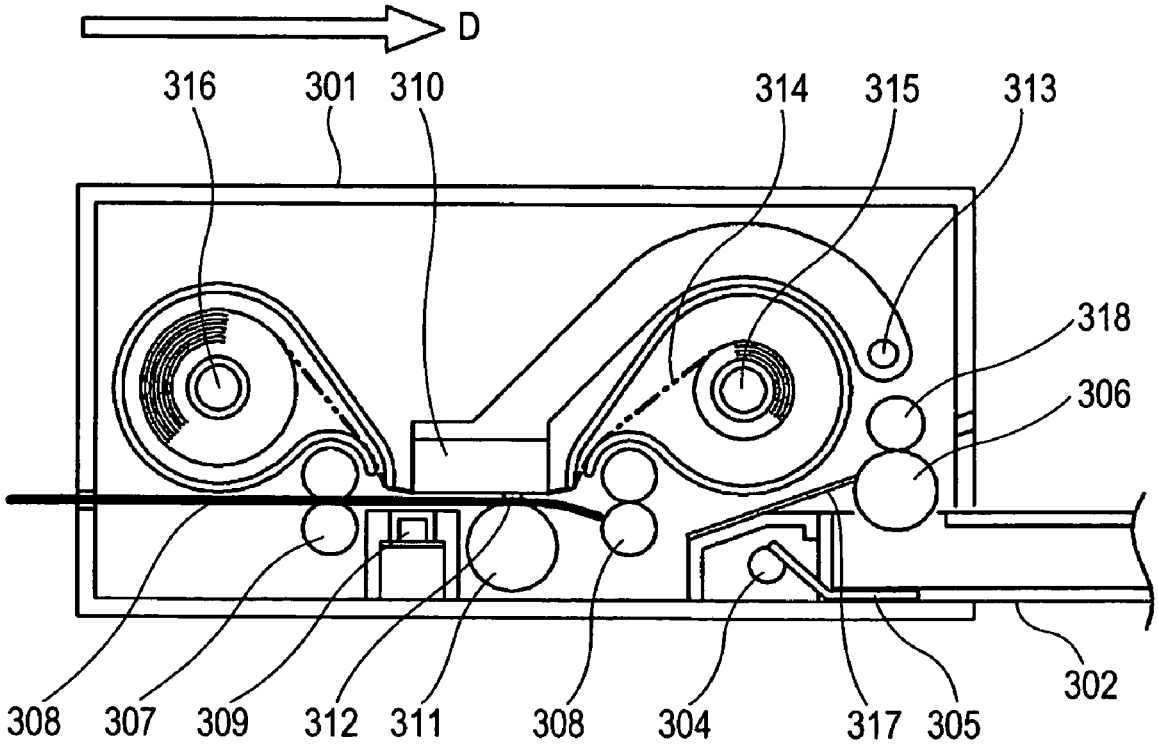
FIG. 7 illustrates a downstream rotator pair in which the leading edge of a recording medium is brought into contact with one of the rotators of the downstream rotator pair according to the second embodiment.
Figure 8:
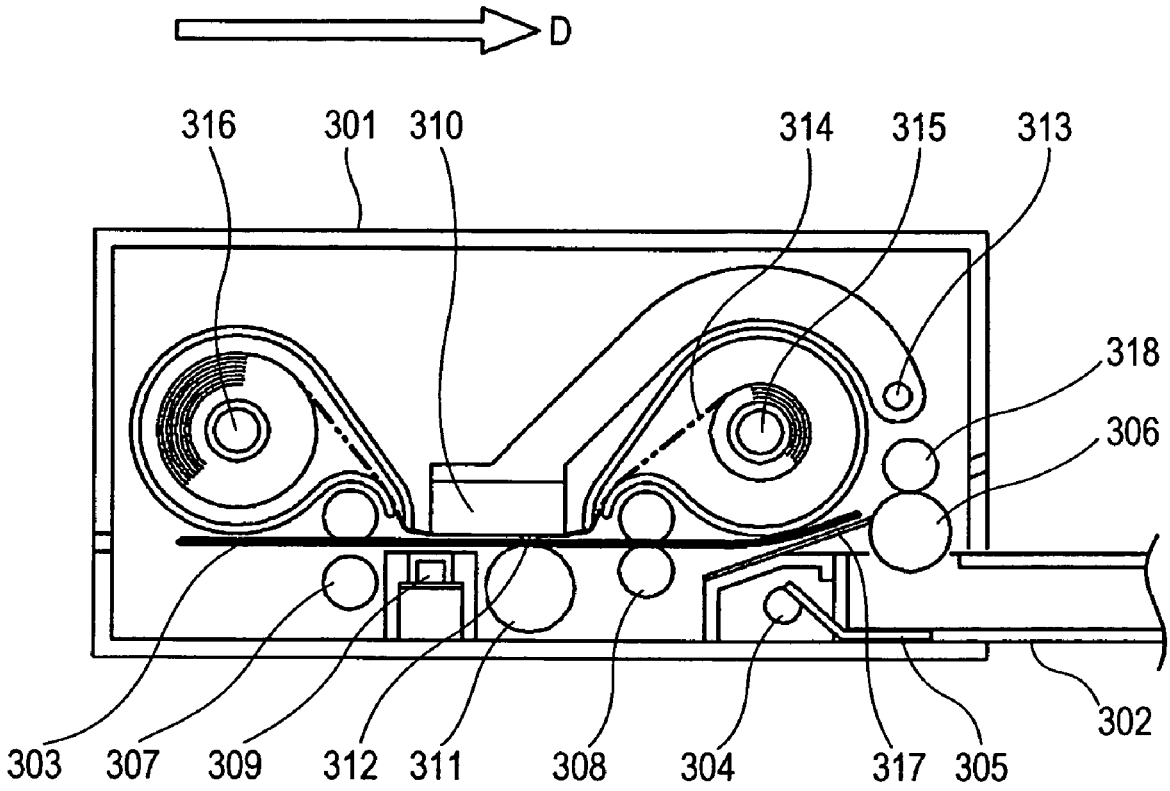
FIG. 8 illustrates an upstream rotator pair when the upstream rotator pair releases the pinch of the recording medium according to the second embodiment.

A recording apparatus according to a second embodiment of the present invention is now herein described in detail with reference to FIGS. 6 to 8. FIG. 6 is a schematic sectional view of the recording apparatus. FIG. 7 illustrates a downstream rotator pair in which a recording medium is brought into contact with one of the rotators of the downstream rotator pair. FIG. 8 illustrates an upstream rotator pair when the upstream rotator pair releases the pinch of the recording medium.

As shown in FIG. 6, a recording apparatus 301 according to this embodiment is a thermal printer that heats an ink ribbon by using a thermal head so as to record an image in accordance with an image signal.

The recording apparatus 301 receives image information transmitted from a computer or a digital apparatus (e.g., a digital camera) via a connection cable or the like (not shown). In response to the reception of the image information, the recording apparatus 301 starts a recording operation on a recording medium. The structure and the recording operation of the recording apparatus 301 are now herein described.

Upon receiving a recording start signal, the recording apparatus 301 causes an up/down plate 305 pivotable about an up/down plate shaft 304 to move a recording sheet 303, which is a recording medium contained in a print paper tray 302. Thus, the recording sheet 303 is brought into contact with a rotating input and output roller 306 so that the sheet 3 is fed into the apparatus body.

The fed recording sheet 303 is transported by sheet transporting means 307 and 308 in a direction opposite to a direction shown by arrow D. According to this embodiment, the sheet transporting means 307 is disposed on the upstream side of a thermal head 310 in the sheet feed direction (hereinafter simply referred to as "upstream transporting means"), while the sheet transporting means 308 is disposed on the downstream side of a thermal head 310 in the sheet feed direction (hereinafter simply referred to as an "downstream transporting means"). Each of the sheet transporting means 307 and 308 includes a pair of rollers, which are rotators. The roller pair pinches the recording sheet 303 so as to feed the recording sheet 303.

When the recording start edge of the recording sheet 303 reaches a recording sheet leading edge detection sensor 309, the upstream transporting means 307 and the downstream transporting means 308 stop feeding the recording sheet 303 in response to a command from the recording apparatus 301.

From the time when the recording sheet 303 is fed into the recording apparatus 301 to the time when the upstream transporting means 307 and the downstream transporting means 308 stop feeding the recording sheet 303, a gap is maintained between the thermal head 310 and a platen roller 311 so that the recording sheet 303 can be transported through the gap.

Subsequently, in response to a command from the recording apparatus 301, the upstream transporting means 307 and the sheet transporting means 308 start feeding the recording sheet 303 in the direction opposite to the current direction of feeding the recording sheet 303, namely, in the direction shown by arrow D.

When the recording start edge of the recording sheet 303 is transported to a heating element line 312 on the thermal head 310 serving as a recording unit, the recording sheet 303 is stopped.

The thermal head 310 starts to move towards the platen roller 311 using a head arm shaft 313 as a fulcrum so that an ink ribbon 314 and the recording sheet 303 are pressed against the platen roller 311. It is noted that the platen roller 311 is rotatably supported by the body of the recording apparatus 301.

Thereafter, a recording operation on the recording sheet 303 is started. That is, the heating element line 312 on the thermal head 310 is started to be energized on the basis of the image information. Ink of the ink ribbon 314 fed from an ink ribbon supply unit 316 is started to be transferred onto the recording sheet 303. At the same time, the upstream transporting means 307 starts feeding the recording sheet 303 in the downstream direction. Also, an ink ribbon take-up unit 315 starts to wind the ink ribbon whose ink has been transferred onto the recording sheet 303.

The recording sheet 303 continues to be fed in the downstream direction. When the recording start edge of the recording sheet 303 reaches the downstream transporting means 308, the upstream transporting means 307 and the downstream transporting means 308 pinch the recording sheet 303 and transport the recording sheet 303.

Additionally, according to this embodiment, in the recording apparatus 301, when the upstream transporting means 307 and the downstream transporting means 308 start to pinch and feed the recording sheet 303, the two rollers of the upstream transporting means 307 are separated from each other by a distance that is greater than or equal to the thickness of the recording sheet 303. Thus, these rollers release the grip of the recording sheet 303 before the recording start edge of the recording sheet 303 passes the upstream roller pair so that the recording sheet 303 is transported by only the downstream transporting means 308 (see FIG. 8).

Even when the moving distance of the recording sheet 303 moved by the upstream transporting means 307 is set to be equal to the moving distance of the sheet 3 moved by the downstream transporting means 308, the moving distances, in practice, are different due to part-to-part variation of precision. Accordingly, if the feed time for which the upstream transporting means 307 and the downstream transporting means 308 pinch the recording sheet 303 is too long, the recording sheet 303 may become stretched or deflected between the upstream transporting means 307 and the downstream transporting means 308. As a result, uneven density may appear in a recorded image. In the recording apparatus according to this embodiment, to address this issue, the two rollers release the recording sheet before the recording sheet passes by the upstream transport roller pair.

The downstream transporting means 308 continues to transport the recording sheet 303 until the recording sheet 303 passes the heating element line 312 on the thermal head 310. Subsequently, the rotation of the upstream transporting means 307 and the downstream transporting means 308 is stopped. Also, the reeling operation of the ink ribbon 314 is stopped. Thus, a printing operation for the first color is completed.

This operation is repeated several times for all the colors so that ink of several different colors is printed on the recording sheet 303 one on top of the other to form a color image. After the color image is formed, the recording sheet 303 is led to an exit path by a flap 317. Thereafter, the recording sheet 303 is output onto the print paper tray 302 by the rotating input and output roller 306 and an output paper pressure roller 318.

According to this embodiment, the recording apparatus 301 includes the sheet transporting means on the upstream side and the downstream side of the recording unit. When printing the first half recording area of the recording sheet 303 adjacent to the recording start edge, the upstream transporting means 307 transports the recording sheet 303. Wile, when printing the second half recording area of the recording sheet 303 adjacent to the recording end edge, the downstream transporting means 308 transports the recording sheet 303. Therefore, a recording operation can be performed without generating margins corresponding to a space for gripping at the leading edge or the trailing edge of the recording sheet 303.

In the printer structures of the first and second embodiments in which a margin is not generated, as described above, two sheet transport rollers disposed on the upstream side and the downstream side are rotated. Accordingly, to drive the two sheet transport rollers by a single drive source and a single gear train, the gear train has a structure shown in FIG. 9.

Figure 9:
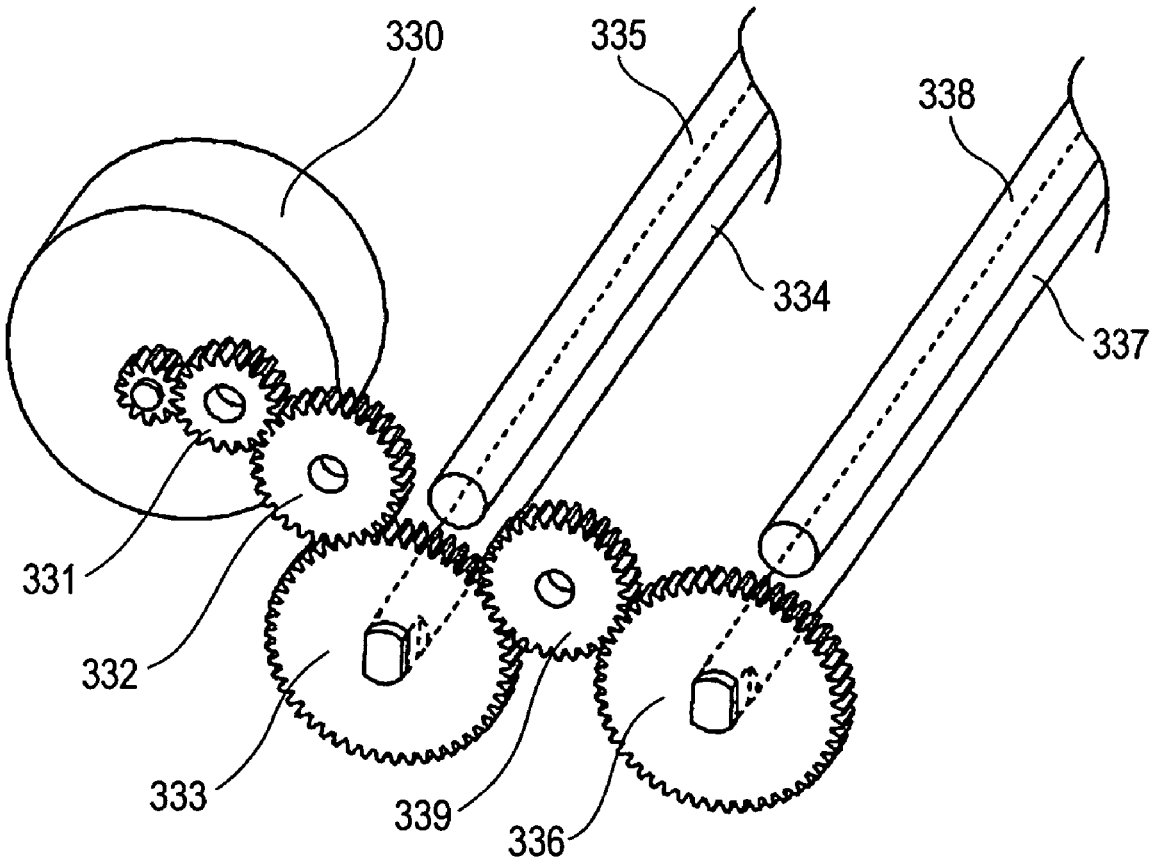
FIG. 9 illustrates a gear train for driving a transport roller according to the first embodiment or the second embodiment.

The gear train shown in FIG. 9 is now herein described briefly.

A drive force from a rotary drive source 330 (217) is transferred to an upstream paper transport roller gear 333 via drive transfer gears 331 and 332. This drive force rotates a roller 334, which is one of the two rollers in the upstream transporting means 307 and which is coupled with the upstream paper transport roller gear 333. The other roller 335 of the two rollers in the upstream transporting means 307 is a driven roller. The drive force transferred to the upstream paper transport roller gear 333 is further transferred to a downstream paper transport roller gear 336 via a relay gear 339. This drive force rotates a roller 337, which is one of the two rollers in the downstream transporting means 308 and which is coupled with the downstream paper transport roller gear 336. The other roller 338 of the two rollers in the downstream transporting means 308 is a driven roller.

Such a gear train includes a series of gears between the rotary drive source 330 and the downstream paper transport roller gear 336, as described above. Accordingly, the number of gears increases. Thus, it is difficult to reduce the size of the printer apparatus.

A third embodiment including another type of a gear train that is suitable for reducing the size of the printer apparatus is now herein described.

Figure 10:
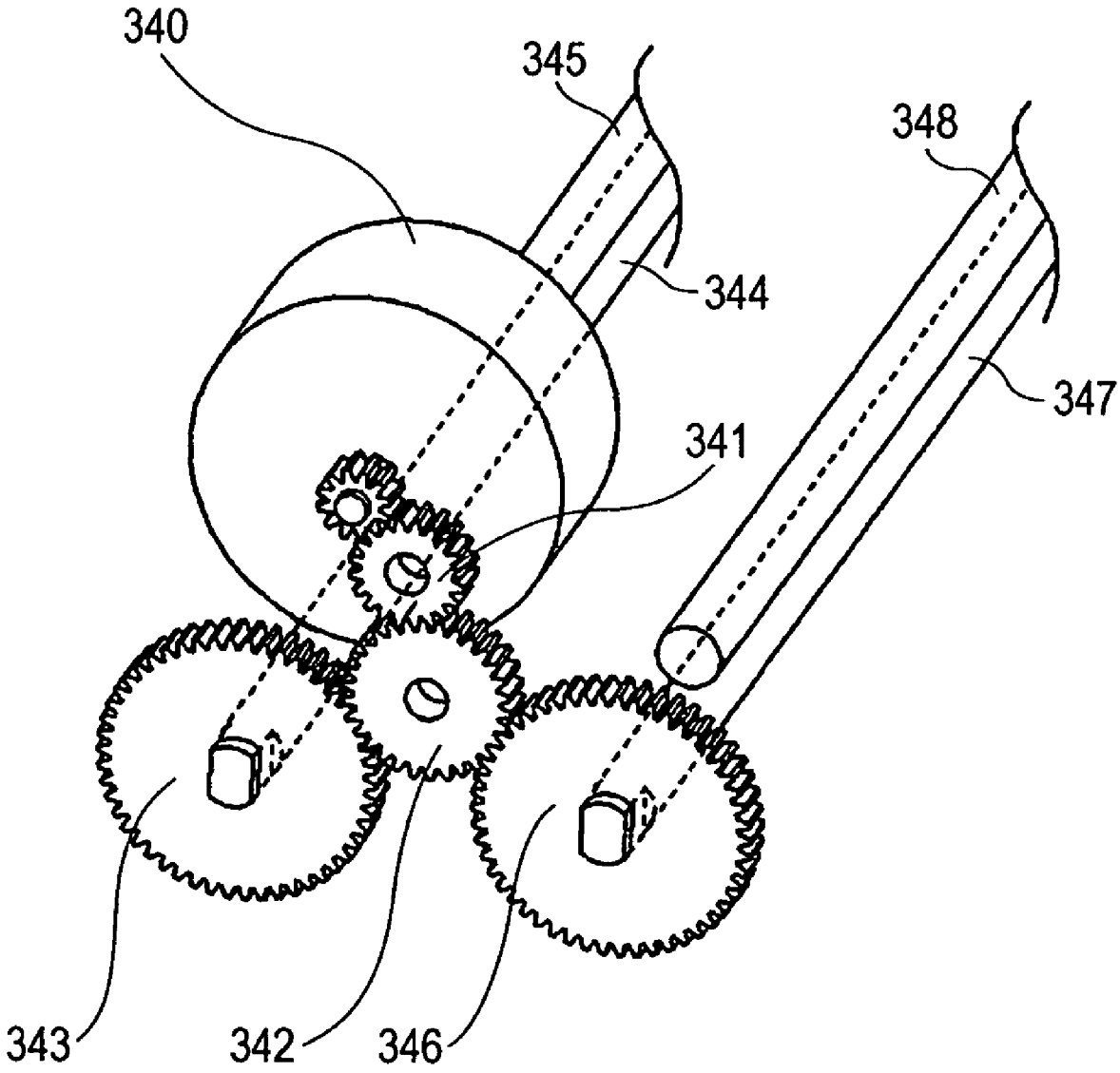
FIG. 10 illustrates a gear train for driving the transport roller according to a third embodiment of the present invention.

A printer apparatus according to the third embodiment of the present invention has a similar structure to that shown in the first or second embodiment with the exception of the structure of the gear train. The gear train according to the third embodiment is now herein described with reference to FIG. 10.

A drive force of a rotary drive source 340 is transferred to a drive force transmission gear 342, which is freely rotatably disposed, via a drive force transmission gear 341.

The rotary drive force transmission gear 342 transfers the drive force to an upstream paper transport roller gear 343 and a downstream paper transport roller gear 346 so as to rotate a roller 344 and a roller 347 at the same time. The roller 344 is one of the two rollers of the upstream transporting means 307. The roller 344 is coupled to the upstream paper transport roller gear 343. While, the roller 347 is one of the two rollers of the downstream transporting means 308. The roller 347 is coupled to the downstream paper transport roller gear 346. The roller 345 is a driven roller, which is the other of the two rollers of the upstream transporting means 307, while the roller 348 is a driven roller, which is the other of the two rollers of the downstream transporting means 308.

Such a gear train can eliminate the need for the relay gear 339 shown in FIG. 9, thereby reducing the size of the gear train. As a result, the size of the printer apparatus can be reduced. Furthermore, since the number of gears is reduced, the manufacturing cost can be reduced.

The operation of the first and second embodiments is now herein described in which one of the two rollers of the downstream transporting means 308 is a driven roller freely rotatably supported.

The leading edge of the recording sheet 303 moving towards the downstream transporting means 308 does not always move straight, but sometimes slightly swings upward or downward. Therefore, the leading edge collides with either one of the two transport rollers of the downstream transporting means 308 first (see FIG. 7). If the leading edge collides with the rotating drive roller, no problem occurs. However, if the leading edge collides with the driven roller, the shock of the collision is large compared with that resulting from a collision with the rotating drive roller, since the driven roller is not rotating when the recording sheet 303 collides with the driven roller. As the magnitude of the shock increases, the transport speed of the recording sheet 303 varies more easily. Consequently, uneven density in the recording image easily occurs.

A fourth embodiment that improves this problem is now herein described. In a recording apparatus according to the fourth embodiment, the downstream transporting means 308 includes two rollers either of which is a drive roller so that a shock is reduced regardless of which roller collides with the recording sheet 303.

Additionally, a control is performed so that the pair of rollers of the upstream transporting means 307 releases the pinch of the recording sheet 303 at a predetermined timing. Thus, the transport speed of the recording sheet 303 is maintained constant, and therefore, the occurrence of uneven density in a recording image can be prevented. As a result, a stable high-quality recording image can be output.

While an exemplary embodiment of the present invention has been described with reference to a recording apparatus including a pair of rollers of the downstream transporting means 308 each of which is a drive roller, the upstream transporting means 307 may also include a pair of rollers each of which is a drive roller. In this structure, a shock can be reduced when the edge of the recording sheet 303 collides with the upstream transporting means 307.

Furthermore, while an exemplary embodiment of the present invention has been described with reference to a pair of rollers serving as a pair of rotators that feeds the recording sheet 303, the pair of rollers is not intended to be limited to such applications. For example, a pair of rotating belts may feed the recording sheet 303 in place of the pair of rollers.

Still furthermore, while an exemplary embodiment of the present invention has been described with reference to a recording unit using a thermal transfer method in which a thermal head selectively heats an ink ribbon and the fused ink is transferred to a recording sheet, the thermal transfer method is not intended to be limited to such applications. For example, the recording unit may employ a thermal recording method in which an image is recorded on thermal recording paper without using an ink ribbon. Alternatively, the recording unit may employ an inkjet recording method in which an image is recorded by ejecting ink from a recording head.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-088620 filed Mar. 25, 2005, No. 2005-168211 filed Jun. 8, 2005, and No. 2005-128965 filed Apr. 27, 2005, which are hereby incorporated by reference herein in their entirety.

The invention claimed is:

1. A recording apparatus comprising:

a first transport roller pair for transporting a sheet in a transport direction;

a second transport roller pair disposed downstream of the first transport roller pair in the transport direction, the second transport roller pair transporting the sheet in cooperation with the first transport roller pair; and a recording head disposed between the first transport roller pair and the second transport roller pair, the recording head sequentially transferring a plurality of types of ink from an ink ribbon onto the sheet transported by one of the first transport roller pair and the second transport roller pair;

wherein, when the second transport roller pair transports the sheet delivered from the first transport roller pair, rollers of the second transport roller pair are separated from each other by a distance greater than the thickness of the sheet, and wherein, after the sheet enters the nip of the rollers, the second transport roller pair pinches the sheet, and wherein rollers of the first transport roller pair are separated from each other by a distance greater than the thickness of the sheet when the second transport roller pair pinches the sheet.

2. The recording apparatus according to claim 1, wherein the rollers of the first transport roller pair are separated from each other by a distance greater than the thickness of the sheet after the second transport roller pair pinches the sheet.

3. The recording apparatus according to claim 1, further comprising:

a platen roller for pinching the sheet in cooperation with the recording head;

wherein the first transport roller pair moves the leading edge of the sheet into a nip defined by the recording head and the platen roller, and the recording head performs a recording operation onto the sheet so as not to generate a margin at the leading edge of the sheet.

4. The recording apparatus according to claim 3, further comprising:

ink ribbon transporting means for transporting an ink ribbon applied with ink in the nip defined by the recording head and the platen roller;

wherein the recording head transfers the ink of the ink ribbon onto a recording medium.

5. The recording apparatus according to claim 4, wherein the recording head continues to perform a recording operation after the trailing edge of the sheet has passed the nip defined by the recording head and the platen roller in order not to generate a margin at the trailing edge of the sheet.

6. The recording apparatus according to claim 5, wherein the sheet is transported towards the upstream side by the second transport roller pair after the sheet has passed the recording head and is transported towards the upstream side by the first transport roller pair until the sheet has passed the recording head.

7. An image forming apparatus comprising:

a feeder unit for feeding a sheet medium along a path;

an image forming unit for forming an image on the sheet medium;

first transporting means for transporting the sheet medium; and second transporting means for transporting the sheet medium; the first and second transporting means being provided on opposite sides of the image forming unit along said path; and control means for controlling which transporting means is used to transport the sheet medium in a given direction along said path, wherein the sheet medium is transported in a first direction towards the image forming unit such that an area adjacent the leading edge of the sheet is able to have an image formed thereon, the sheet medium being transported past the image forming unit in said first direction such that when the sheet medium is transported in the opposite direction along said path an area adjacent the opposite edge of the sheet is able to have an image formed thereon, thereby enabling formation of an image substantially on the entire surface of the sheet medium, wherein each of the first transporting means and the second transporting means includes a pinch adjustment mechanism capable of rotating in the clockwise and counterclockwise directions so as to pinch and feed the sheet medium in either direction along said path, wherein, while the image forming unit is performing a recording operation, the pinch adjustment mechanism of each of the first transporting means and the second transporting means is capable of adjusting a gap size for pinching the sheet medium, and wherein, when the recording start edge of the sheet medium whose first part of the recording area has been subject to image formation enters the second transporting means on the downstream side from the image forming unit, the pinch adjustment mechanism on the downstream side adjusts the gap size for pinching the sheet medium to a size greater than or equal to the thickness of the sheet medium, and wherein, when the recording end edge of the sheet medium whose second part of the recording area has been subject to image formation exits the first transporting means on the upstream side, the pinch adjustment mechanism on the upstream side adjusts the gap size for pinching the sheet medium to a size greater than or equal to the thickness of the sheet medium.

8. An image forming apparatus comprising:

a feeder unit for feeding a sheet medium along a path;

an image forming unit for forming an image on the sheet medium;

first transporting means for transporting the sheet medium; and second transporting means for transporting the sheet medium; the first and second transporting means being provided on opposite sides of the image forming unit along said path; and control means for controlling which transporting means is used to transport the sheet medium in a given direction along said path, wherein the sheet medium is transported in a first direction towards the image forming unit such that an area adjacent the leading edge of the sheet is able to have an image formed thereon, the sheet medium being transported past the image forming unit in said first direction such that when the sheet medium is transported in the opposite direction along said path an area adjacent the opposite edge of the sheet is able to have an image formed thereon, thereby enabling formation of an image substantially on the entire surface of the sheet medium, wherein the first transporting means is responsible for feeding a first part of the recording area of the sheet medium and the second transporting means is responsible for feeding a second part of the recording area of the sheet medium, wherein each of the first transporting means and the second transporting means includes a pinch adjustment mechanism capable of rotating in the clockwise and counterclockwise directions so as to pinch and feed the sheet medium in either direction along said path, wherein, while the image forming unit is performing a recording operation, the pinch adjustment mechanism of each of the first transporting means and the second transporting means is capable of adjusting a gap size for pinching the sheet medium, and wherein, when the recording start edge of the sheet medium whose first part of the recording area has been subject to image formation enters the second transporting means on the downstream side from the image forming unit, the pinch adjustment mechanism on the downstream side adjusts the gap size for pinching the sheet medium to a size greater than or equal to the thickness of the sheet medium, and wherein, when the recording end edge of the sheet medium whose second part of the recording area has been subject to image formation exits the first transporting means on the upstream side, the pinch adjustment mechanism on the upstream side adjusts the gap size for pinching the sheet medium to a size greater than or equal to the thickness of the sheet medium.

* * * * *